US008421577B2

(12) United States Patent
Tiemeijer

(10) Patent No.: US 8,421,577 B2
(45) Date of Patent: Apr. 16, 2013

(54) PLANAR INDUCTIVE UNIT AND AN ELECTRONIC DEVICE COMPRISING A PLANAR INDUCTIVE UNIT

(75) Inventor: Lukas Frederik Tiemeijer, Eindhoven (NL)

(73) Assignee: NXP B.V., Eindhoven (NL)

( * ) Notice: Subject to any disclaimer, the term of this patent is extended or adjusted under 35 U.S.C. 154(b) by 15 days.

(21) Appl. No.: 12/988,889

(22) PCT Filed: Apr. 21, 2009

(86) PCT No.: PCT/IB2009/051631

§ 371 (c)(1),
(2), (4) Date: Oct. 21, 2010

(87) PCT Pub. No.: WO2009/130665

PCT Pub. Date: Oct. 29, 2009

(65) Prior Publication Data

US 2011/0050383 A1 Mar. 3, 2011

(30) Foreign Application Priority Data

Apr. 21, 2008 (EP) ..... 08154899

(51) Int. Cl.
*H01F 5/00* (2006.01)

(52) U.S. Cl.
USPC ..... 336/200

(58) Field of Classification Search ..... 336/84 R, 336/84 C, 200, 232, 65, 83, 192; 257/531
See application file for complete search history.

(56) References Cited

U.S. PATENT DOCUMENTS

| | | | | |
|---|---|---|---|---|
| 6,320,491 | B1 | 11/2001 | Gevorgian et al. | |
| 6,529,720 | B1 | 3/2003 | Jovenin et al. | |
| 6,894,598 | B2 * | 5/2005 | Heima | 336/200 |
| 6,950,590 | B2 | 9/2005 | Cheung et al. | |
| 7,382,219 | B1 * | 6/2008 | Lee | 336/84 C |
| 7,733,205 | B2 * | 6/2010 | Hyvonen | 336/84 C |
| 2004/0140878 | A1 | 7/2004 | Heima | |
| 2004/0217839 | A1 | 11/2004 | Haaren et al. | |
| 2005/0051871 | A1 | 3/2005 | Lowther et al. | |
| 2005/0104158 | A1 * | 5/2005 | Bhattacharjee et al. | 257/531 |
| 2005/0195063 | A1 | 9/2005 | Mattsson | |

(Continued)

FOREIGN PATENT DOCUMENTS

| | | | |
|---|---|---|---|
| JP | 2004095777 | A | 3/2004 |
| WO | 9850956 | A1 | 11/1998 |
| WO | 2004012213 | A1 | 2/2004 |
| WO | 2004055839 | A1 | 7/2004 |

OTHER PUBLICATIONS

Tang, C-C, et al; "Miniature 3-D Inductors in Standard SMOS Process"; IEEE Journal of Solid-State Circuits, vol. 37, No. 4; pp. 471-480 (Apr. 2002).

(Continued)

*Primary Examiner* — Tuyen Nguyen

(57) ABSTRACT

A planar inductive unit having at least one operating frequency is provided. The inductive unit comprises at least one inductor winding (120) having a first width (121) and a centre (122) and being arranged in a first plane. The inductive unit furthermore comprises at least one ground path (200) having a first section (205) extending in the first plane and at least a second section (210) with a second width (211) extending in at least a second plane.

13 Claims, 8 Drawing Sheets

U.S. PATENT DOCUMENTS

| | | | | |
|---|---|---|---|---|
| 2005/0206477 | A1 | 9/2005 | Cheema et al. | |
| 2005/0258507 | A1 | 11/2005 | Tseng et al. | |
| 2006/0049481 | A1 * | 3/2006 | Tiemeijer et al. | 257/531 |
| 2006/0220778 | A1 | 10/2006 | Marques | |
| 2006/0226943 | A1 | 10/2006 | Marques | |

OTHER PUBLICATIONS

Tiemeijer, L. F., et al; "Predictive Spiral Inductor Compact Model for Frequency and Time Domain"; Proceedings of International Electron Device Meeting; pp. 878-878; (2003).

Lee, Chih-Yuan, et al; "A Simple Systematic Spiral Industor Design With Perfect Design With Perfected Q Improvement for CMOS RFIC Application"; IEEE Transactions on Microway Theory and Technologies, vol. 53, No. 2; 6 Pages; (Feb. 1, 2005).

Han, Yehui, et al; "Analysis and Design of High Effiiency Matching Networks"; IEEE Transactions on Power Electronics, vol. 21, No. 5; pp. 1484-1491; (Sep. 2006).

International Search Report for Application PCT/IB2009/051631 (Apr. 21, 2009).

* cited by examiner

PLANAR INDUCTIVE UNIT AND AN ELECTRONIC DEVICE COMPRISING A PLANAR INDUCTIVE UNIT

FIELD OF THE INVENTION

The present invention relates to a planar inductive unit and an electronic device comprising a planar inductive unit.

BACKGROUND OF THE INVENTION

When different circuits are coupled to each other, often the impedances thereof do not match. Therefore, an impedance matching network may be required to match the output impedance of a first unit to the input impedance of a second subsequent unit, i.e. the output impedance of a source is made equal to the output impedance of a load. Here, the first impedance can be e.g. an amplifier stage in a RF circuit and the second impedance may be an input impedance of an amplifier stage or an antenna.

WO 2004/055839 A1 discloses a planar inductive component which is arranged over a substrate. The substrate comprises a winding which is situated in a first plane and a patent ground shield for shielding the winding from the substrate.

FIGS. 1A and 1B show a circuit diagram of Pi matching networks according to the prior art. The matching network according to FIG. 1A comprises an inductor L, two capacitors C, connecting a load with an input impedance Z1 to a source with an output impedance. It should be noted that a non-zero ground inductance Lg can be present. Such a non-zero ground inductance is not desirable as it will have a negative influence on the behaviour of the matching network.

FIG. 2A shows a basic representation of an inductor in an integrated circuit. In particular, the inductor has been placed in a two-port ground-signal-ground test configuration in order to test the performance of the IC inductor. In FIG. 2A, a representation of an IC inductor is depicted which can for example be used in the matching networks according to FIGS. 1*a* and 1*b*. It should be noted that the inductor performance evaluation structure according to FIG. 2A comprises two very wide ground lines GL placed symmetrically around the inductor I. It should further be noted that the ground lines GL need to be very wide to minimize the inductance Lg. Furthermore, they should be placed with sufficient clearance from the inductor to ensure that the performance of the inductor I is not affected. If the IC inductor according to FIG. 2A is investigated, for example by means of simulations, the result will correspond to the circuit of FIG. 1B instead of the circuit according to FIG. 1A. It should be noted that the huge area covered by the two ground lines can be a problem and is in particular not desirable. If the ground lines are removed or if their width is reduced, the ground inductance is increased significantly.

FIG. 2B shows an 8 shaped inductor according to the prior art. The inductor according to FIG. 2B corresponds to the inductor as depicted in WO 2004/012213 A1. If several conductors are placed adjacent to each other, a crosstalk between the inductors may lead to undesired effects. According to WO 2004/012213 A1, two oppositely directed current loops 211, 212 in an 8 shaped inductor are advantageous with respect to the cancellation of the magnetic fields such that the crosstalk can be reduced. The eye 209 of the winding to which the supply lines lead to is smaller than the other eye 210. This can be performed in order to compensate for the magnetic fields of the supply lines. The specific implementation of this requirement can be very tricky in particular as the geometry of the supply lines and the return path of the ground current should be known before the correction is performed.

FIG. 3 shows a three dimensional view of an inductor unit according to the prior art. Here, a ground path 200 and the inductor 100 is depicted. The inductor 100 comprises a number of turns 120 and is implemented as a planar inductor. The inductive component also comprises an underpass 110 which is used to couple one end of the inductor turns to one inductor terminal. It should be noted that the width as well as the clearance of the ground paths 200 have been reduced as compared to the inductor according to FIG. 2A. This is performed in order to minimize the footprint of the device.

SUMMARY OF THE INVENTION

It is therefore an object of the invention to provide a planar inductive component with an improved ground path inductance.

This object is solved by a planar inductive component according to claim 1 or 5 and an electronic device according to claim 8.

Therefore, a planar inductive unit with at least one operating frequency is provided. The planar inductive unit comprises at least one inductor winding having a first width and a centre. The at least one conductor winding is arranged in a first plane. The planar inductive unit furthermore comprises at least one ground path having a first section extending in the first plane and at least a second section with a second width extending in at least a second plane.

According to an aspect of the invention, the second width of the second section of the ground path and/or an offset of the second section of the ground path and/or an offset of the second section of the ground path from the centre of the at least one inductor winding is selected such that the mutual inductance of the at least one winding and the ground path equals a negative inductance of the ground path at the at least one operating frequency.

According to a further aspect of the invention, the inductor winding is arranged in a first metal layer in the first plane and the second section of the ground path is arranged in a second layer in the second plane.

According to a further aspect of the invention, the planar inductive unit comprises a ground shield unit which is arranged in a third plane and which is used for shielding the at least one winding from a substrate.

The invention also relates to a planar inductive unit having at least one operating frequency. The planar inductive unit comprises at least one 8 shaped inductor having at least one first and at least one second eye. The inductor is arranged in a first plane and has at least one first width. The inductive unit furthermore comprises at least one ground path having a second width and extending in the first plane. The ground path is arranged between the first and second eye of the at least one inductor.

According to an aspect of the invention, the inductor comprises at least one underpass for coupling the first and second eye. The underpass is arranged in a second plane.

According to a further aspect of the invention, the distance between the first and second eye and the ground path is selected such that the mutual inductance of the first and second eye and the ground path equals a negative inductance of the ground path at the at least one operating frequency.

The invention also relates to an electronic device which comprises at least one planar inductive unit as described above.

The invention relates to the idea to use the ground path as a part of an impedance matching inductor or an inductive unit.

Furthermore, instead of minimizing the ground inductance by minimizing the length of the ground path, the adverse effect of the ground impedance can optionally be compensated by a mutual inductance between the signal current and the ground current. It should be noted that the ground inductance relates to the development of a ground lift voltage Vg at the load impedance. The signal voltage corresponds to $V_s=j\omega(L_sI_s+M_{sg}I_g)$ and the ground voltage corresponds to $V_g=j\omega(L_gI_g+M_{sg}I_s)$. Is and Ig correspond to the signal currents and the ground currents. If the impedances are matched, the signal and ground currents are equal, i.e. the ground lift voltage Vg can be minimized by providing a ground path such that Msg equals −Lg at the operating frequency of the matching network.

The invention also relates to the idea to place a ground path between a first and second eye of an 8 shaped inductor, wherein the ground path is arranged in the same plane as the inductor.

BRIEF DESCRIPTION OF THE DRAWINGS

Embodiments and advantages of the present application will be described in more detail with reference to the Figures.

DETAILED DESCRIPTION OF EMBODIMENTS

Figure 4:
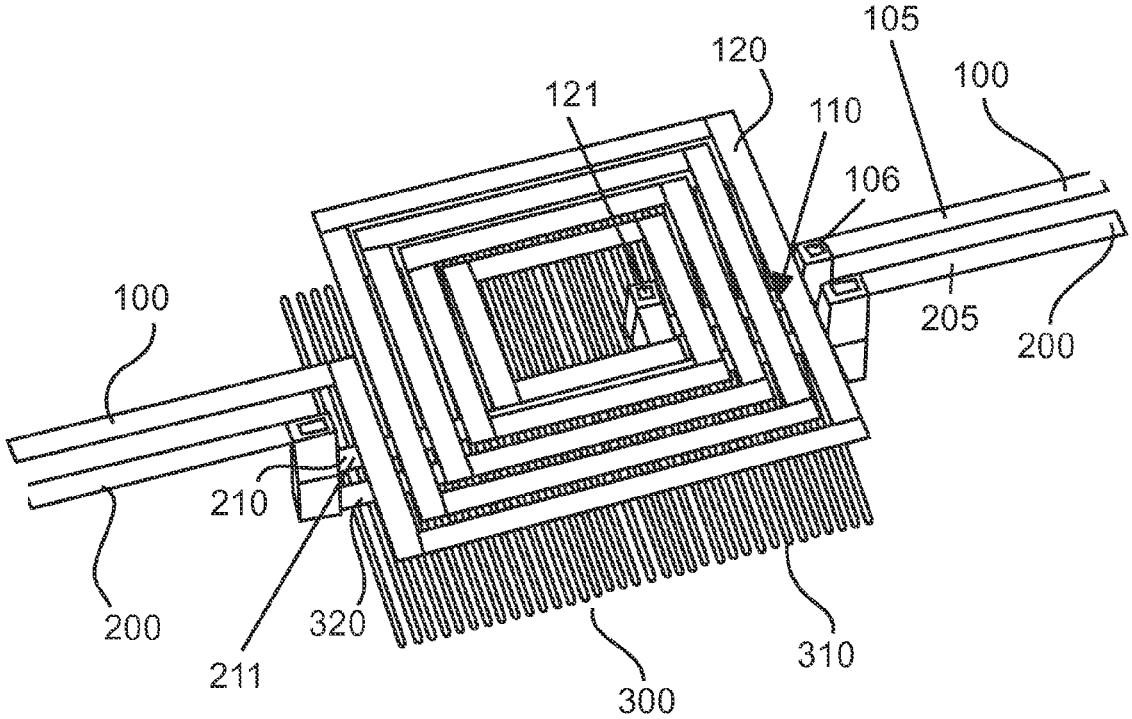
FIG. 4 shows a three dimensional view of an inductive unit according to a first embodiment.

FIG. 4 shows a three dimensional view of an inductive unit according to a first embodiment. The inductive component comprises an inductor 100 with a first width 105 and several inductive turns 120 as well as an underpass 100 for coupling one terminal 106 of the inductor to the end of the inductor turns 121. Furthermore, a ground path 200 with a second width 211 and an underpass 210 and a ground shield 300 is depicted.

Figure 1A:
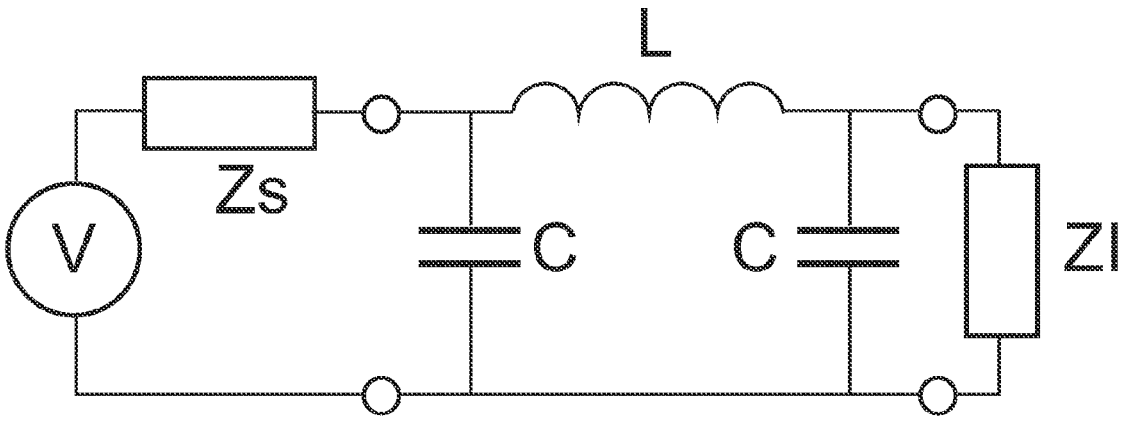
FIGS. 1A and 1B show a circuit diagram of Pi matching networks according to the prior art.
Figure 1B:
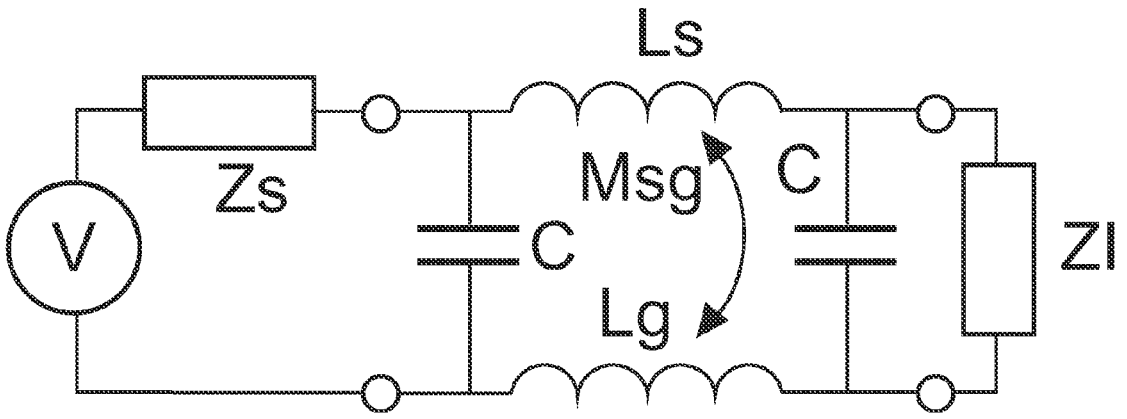
Figure 2A:
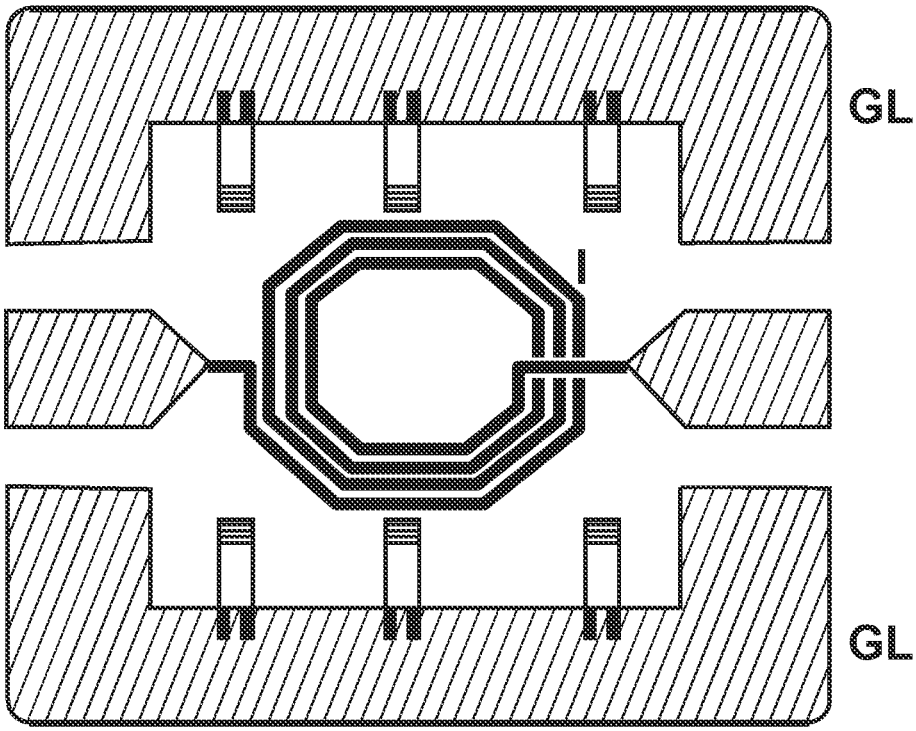
FIG. 2A shows a basic representation of an inductor in an integrated circuit according to the prior art.
Figure 2B:
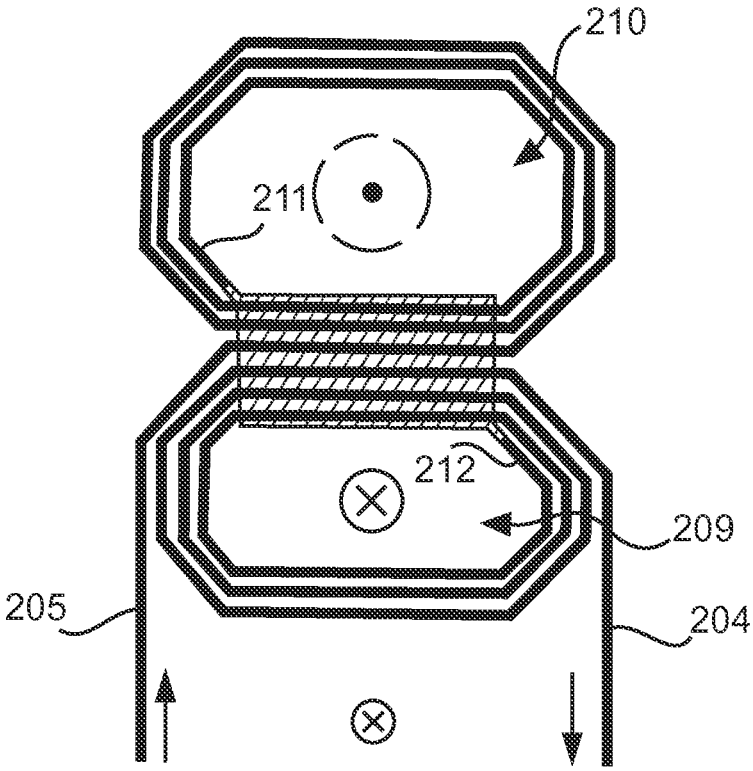
FIG. 2B shows an 8 shaped inductor according to the prior art.
Figure 3:
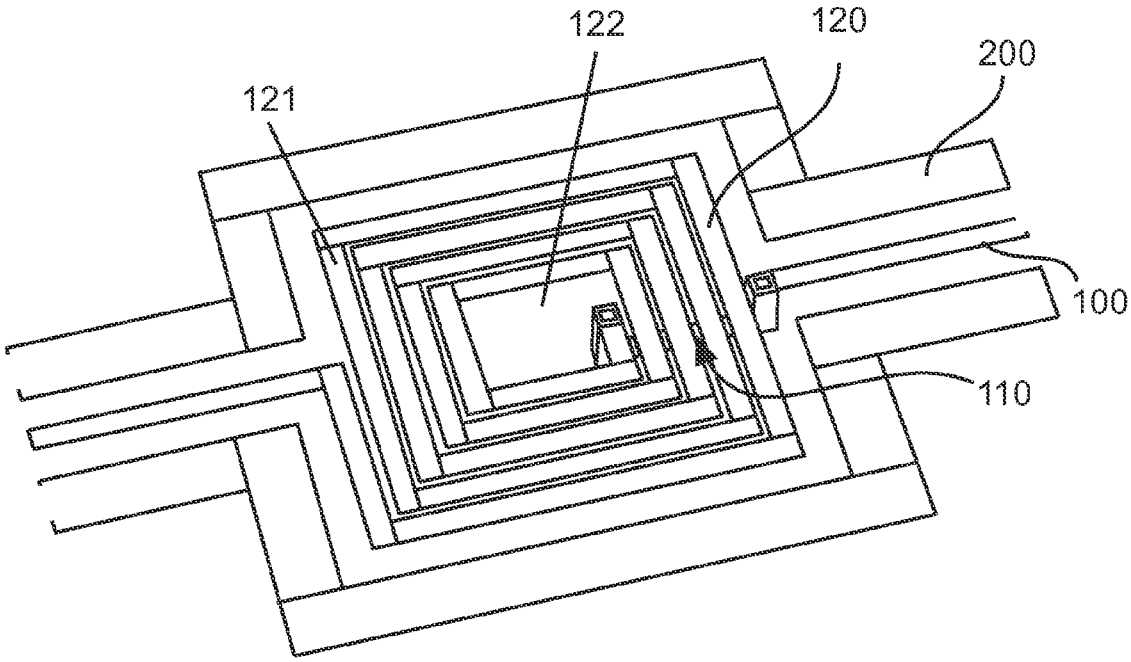
FIG. 3 shows a three dimensional view of an inductor unit according to the prior art.

It should be noted that the footprint of the inductive component according to the first embodiment as compared to the footprint of the inductive component according to the prior art as depicted in FIG. 3 is reduced by a factor of 2 from for example 0.23 $mm^2$ down to 0.11 $mm^2$. The turns 120 of the inductor are for example implemented by 3 μm aluminium top metal layer which can be manufacture in an IC manufacturing process. The underpass 110, 210 can be implemented by a 1 μm thick semiconductor metal layer. The ground shield 300 can be made of a 0.3 μm bottom metal layer. The separation between the metal layers can for example be 3 μm. The resistivity of the substrate is for example 10 ohm/cm which can be manufactured by a typical IC process. Optionally, the ratio between the width of the turns 120 of the conductor to the width of the underpass is approx. 3:1.

It should be noted that in contrast to the prior art inductor according to FIG. 3, the ground path is realized by an underpass 210 which can for example be implemented in a lower metal layer. The width and the offset of the ground underpass 210, 110 are chosen in order to realize the condition Msg=−Lg at the operating frequency of the matching network. It should be noted that Lg depends on the width 211 of the ground underpass 210 and that Lg is reduced if the width 211 of the underpass is increased. Msg increases with the offset of the ground underpass from the centre of the inductor until the underpass is immediately below the two outer most turns of the inductor 100.

The opposite signs of the Lg and Msg can be realized by an offset as depicted in FIG. 4. Preferably, the ground path is not implemented in the same metal layer as the inductor 100. Preferably, the inductor comprises more than a single turn. By the inductive component according to the first embodiment, a multi-turn impedance matching inductor can be realized which also enables a ground inductance cancellation.

Optionally, the inductive component according to the first embodiment also comprises a ground shield 300 which can be patterned and which can be realized in a further (third) metal or polysilicon layer. The ground shield is used in order to reduce losses which may arise from a capacitive coupling of the lossy substrate.

For the cases that the substrate resistivity is large (larger than 100 ohm/cm) or very low (less than 0.1 ohm/cm) such a substrate is less lossy for capacitive currents. Hence, in such a situation, the ground shield 300 can be omitted.

Figure 5:
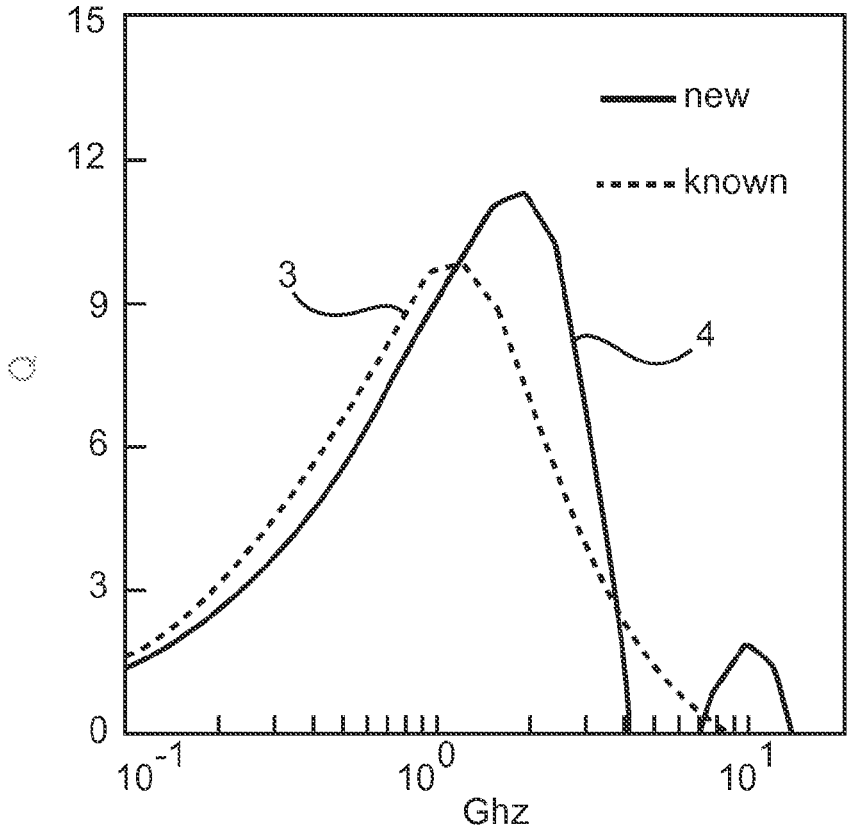
FIG. 5 shows a graph of the quality factor versus the frequency of an inductor component according to the first embodiment.

FIG. 5 shows a graph of the quality factor Q versus the frequency of an inductive unit/component according to the first embodiment. Here, a graph 3 depicting the quality factor versus the frequency of the prior art inductor and a graph 4 depicting the quality factor versus the frequency of the inductive component according to the first embodiment is depicted. The inductance of the inductor according to FIG. 3 and the inductive component according to FIG. 4 is both approx. 5 nH. It should be noted that the quality factor Q of the inductive component according to FIG. 4 is reduced at low frequency but it has been improved at the operating frequency of 2 GHz. The reduction of the quality factor at low frequencies are due to the higher resistance of the ground path while the improvement at the operating frequency of 2 GHz is because of the patterned ground shield.

Figure 6:
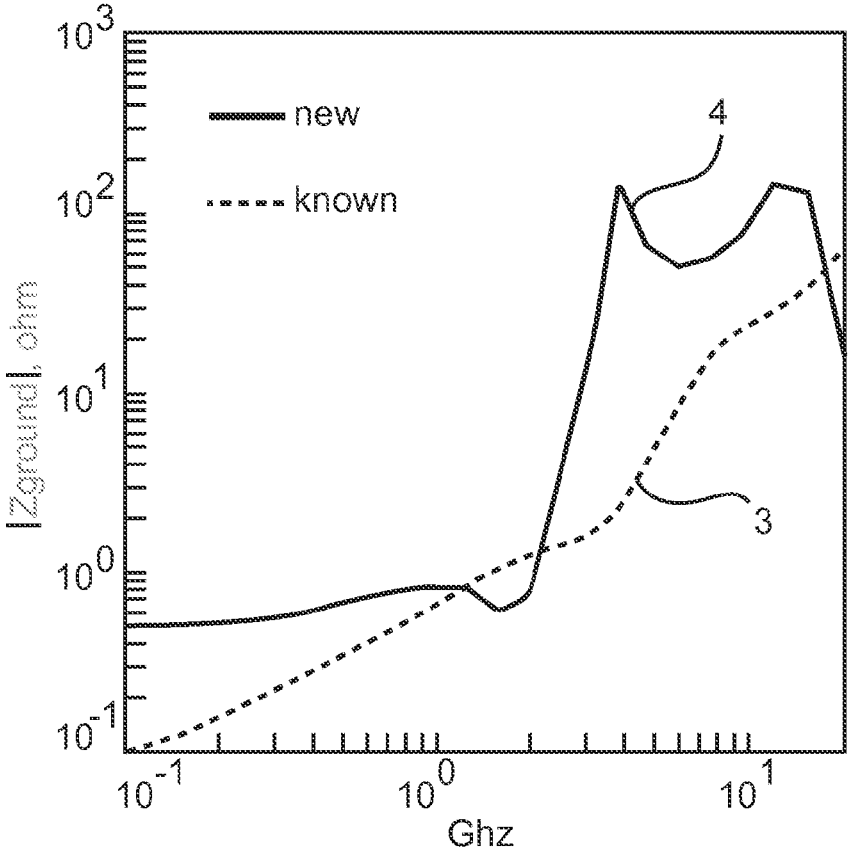
FIG. 6 shows a graph depicting the ground inductance versus the frequency of an inductor according to the prior art as compared to an inductive component according to the first embodiment.

FIG. 6 shows a graph depicting the ground inductance versus the frequency of an inductor according to the prior art as compared to an inductive component according to the first embodiment. By means of the underpass as depicted in FIG. 4, a better or improved ground can be provided at the operating frequency of 2 GHz as compared to a large ground lead as depicted in the prior art inductor in FIG. 3. By positioning the underpass, the required cancellation of inductive effects can be realized.

The inductive component according to the first embodiment is advantageous as its footprint or area is reduced for example by up to 50% while the performance and the operating frequency can be improved. This can be achieved by exploiting a cancellation of inductive effects.

The inductive element according to the first embodiment can be used in almost all application fields like low power fully integrated wireless transceiver chips, power amplifier modules or RF amplification stages.

Figure 7:
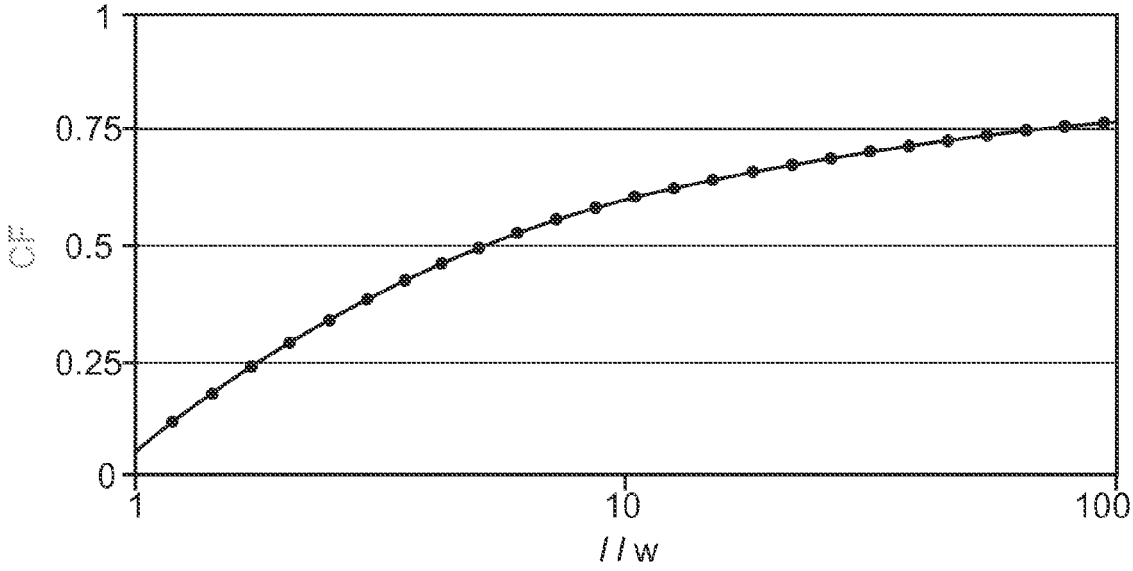
FIG. 7 shows a graph depicting a coupling between two straight lines running in parallel in close proximity.

FIG. 7 shows a graph depicting an inductive coupling between two straight conductors running in parallel in close proximity. Here, the inductive coupling factor CF is depicted versus the length over width ratio l/w. A coupling between two inductor lines running in parallel over a sufficient length is approximately 0.5. According to the second embodiment, the ground lines are provided to pass through a centre point of symmetry signal lines with opposite currents in an 8 shaped inductor are placed sufficiently close to each side of the ground line to achieve a coupling factor with the ground of 0.5. By means of such an arrangement, the ground inductance can be completely cancelled.

Figure 8:
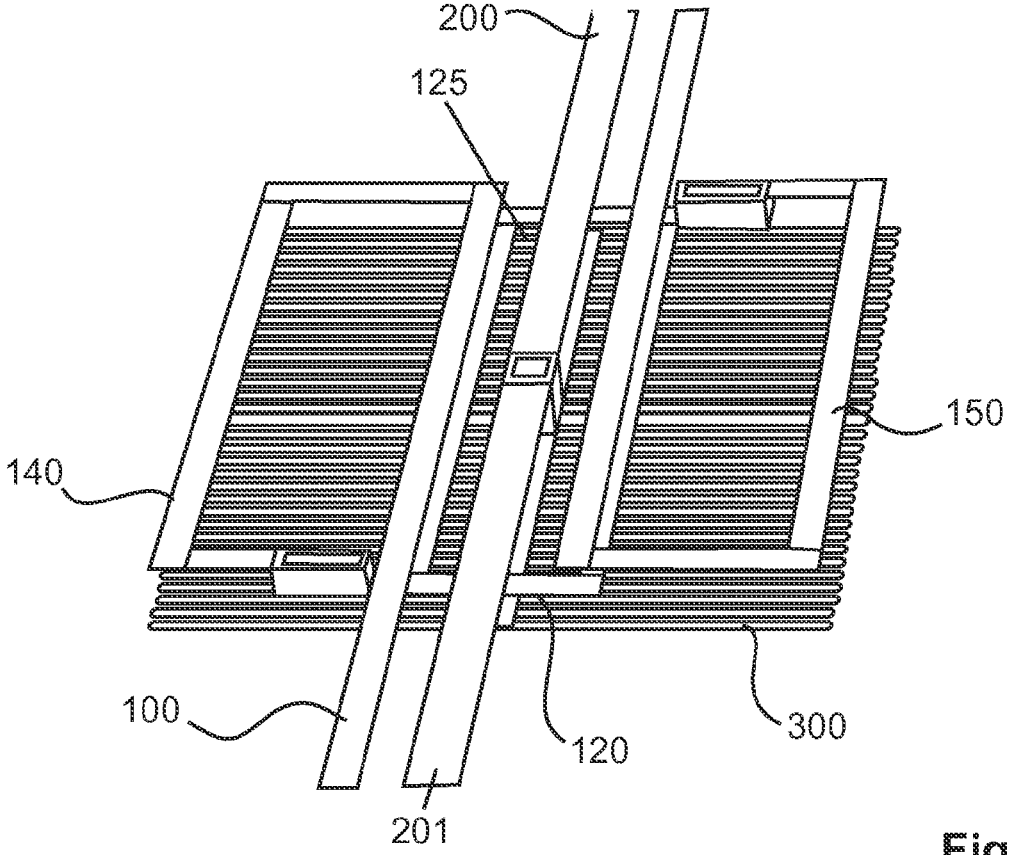
FIG. 8 shows a representation of an inductive unit according to the second embodiment.

FIG. 8 shows a representation of an inductive component according to the second embodiment. The inductive component comprises a ground path 200 with a width 201 and an inductor 100, wherein two eyes 140, 150 of the inductor are provided in order to achieve an 8 shaped inductor. Here, the 8 shaped inductor is realized by two single turns.

The connection or coupling between the first eye 140 and the second eye 150 is implemented by an underpass 120. Preferably, the underpass 120 has a hole 125 in its centre. The ground path 200 is provided in the same layer as the first and second eye 140, 150 while the underpass 120 is provided in a second (lower) layer. The inductive components furthermore comprise a ground shield 300 which can be arranged in a third (lower) layer.

Figure 9:
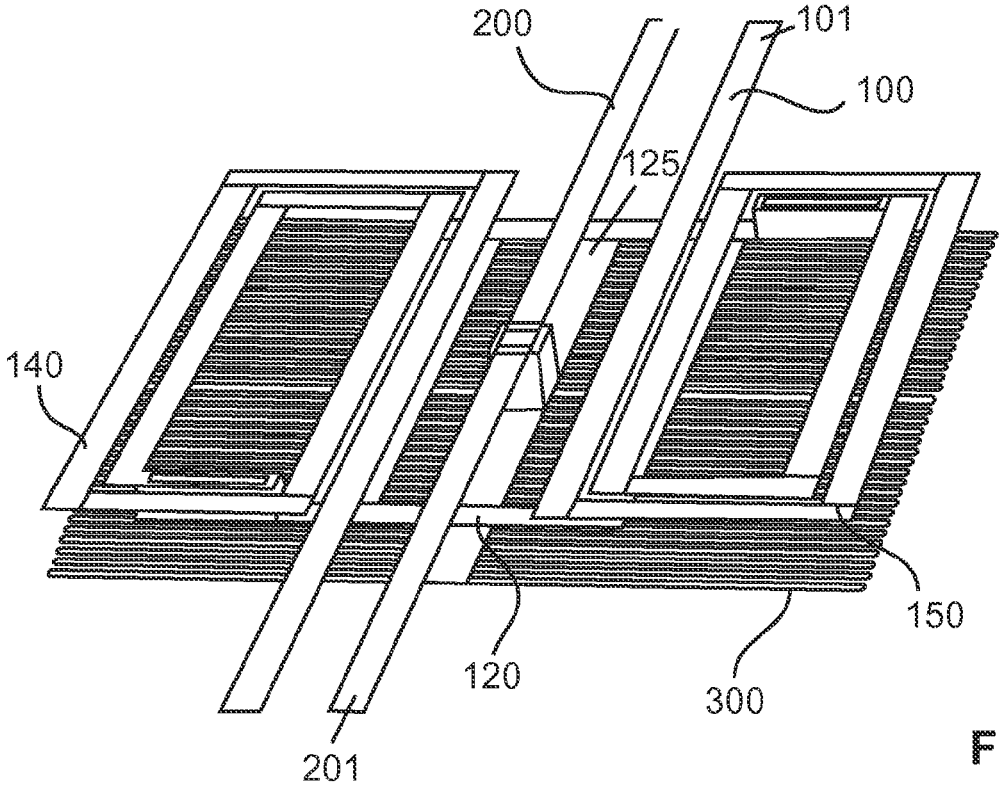
FIG. 9 shows a three dimensional representation of an inductive unit according to the third embodiment.

FIG. 9 shows a three dimensional representation of an inductive component according to the third embodiment. The inductive component according to the third embodiment substantially corresponds to the inductive component according to the second embodiment. The difference is that the inductive components according to the second embodiment each comprise two turns.

The eyes 140, 150 of the 8 shaped inductor according to the second and third embodiment are arranged such that the distance or separation between the eyes is increased such that a ground path 200 and an underpass 120 between the two eyes 140, 150 can be provided. The ground path 200 and the underpass 120 can be provided in a second, lower metal layer. The underpass 120 in the second layer may comprise a hole 125 such that optionally a ground shield 300 can be connected to the ground path 200 (through the hole 125). Furthermore, the capacitance between the underpass 120 and the ground return line as well as the substrate can be reduced by providing the second lower metal layer. In addition, the eddy current loss with may result from the inductor magnetic field in the underpass can be reduced.

It should be noted that the distance between the ground path 200 of the conductor to the ground current return line is chosen that Msg=−Lg in particular at the operating frequency of a matching network. It should be noted that Lg depends on the width of the ground return line and is reduced if its width is increased. Msg decreases with an increasing separation of the eyes. If the eyes are at a minimum distance from the ground return line, typically Msg<−Lg such that a negative net ground inductance is achieved. A negative net ground inductance can be desirable in order to compensate a ground inductance encountered in the circuitry.

Optionally, a patterned ground shield 300 can be provided in a third metal layer or in a polysilicon layer. The patterned ground shield 300 is also used to reduced losses which may result from capacitive coupling to lossy substrates. However, if the substrate resistivity is very high (>100 Ohm/cm) or very low (<0.1 Ohm/cm), such a substrate is less lossy for capacitive currents such that the ground shield may be omitted.

Figure 10:
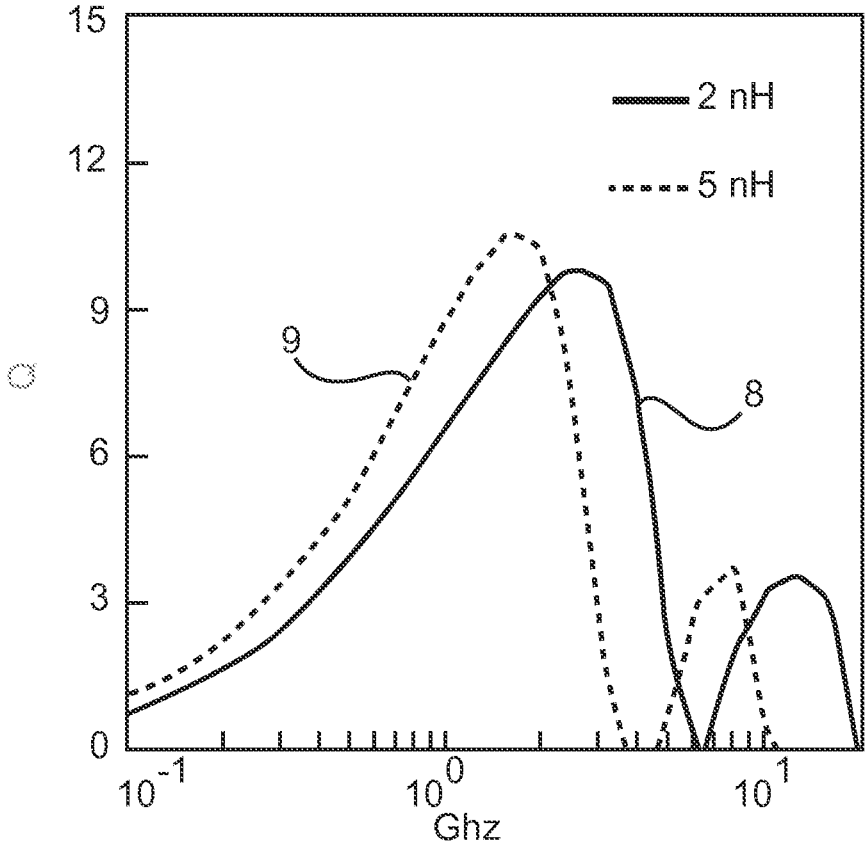
FIG. 10 shows a graph depicting the quality factor versus the frequency of an inductive component according to the second embodiment.

FIG. 10 shows a graph depicting the quality factor Q versus the frequency. Here, a graph 8 depicting the quality factor Q of the inductive component according to FIG. 8 and a graph 9 depicting the quality factor Q of an inductive component according to FIG. 9 is depicted.

Figure 11:
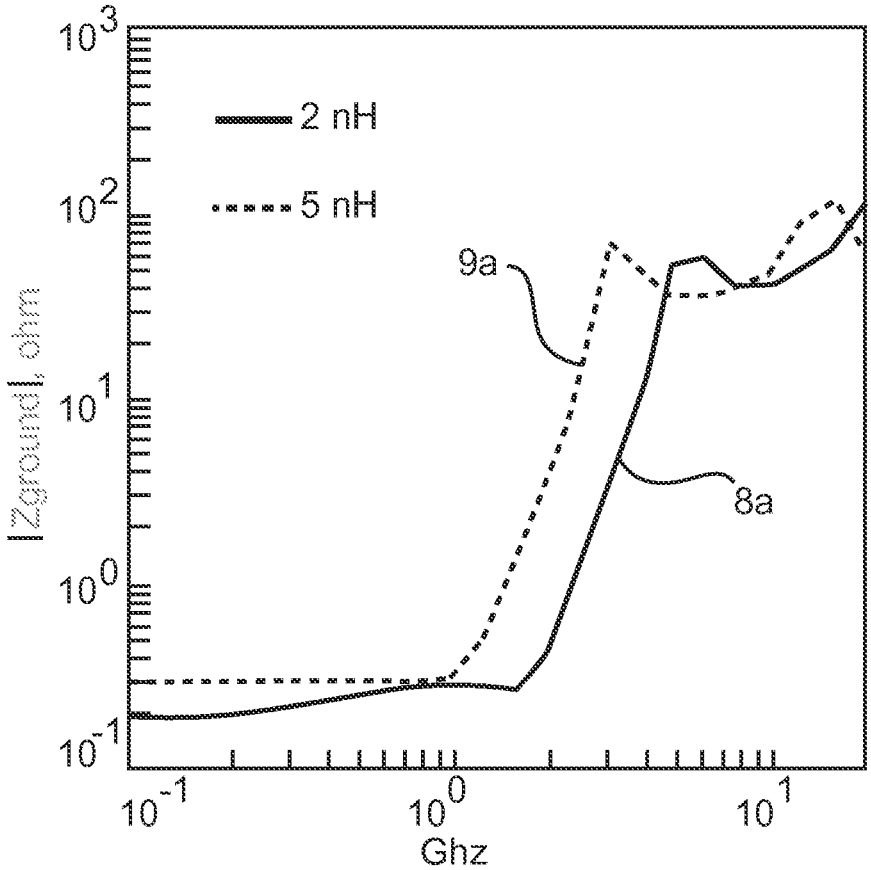
FIG. 11 shows a graph depicting the ground impedance versus frequency of the inductive components according to the second and third embodiment.

FIG. 11 shows a graph depicting the ground impedance versus frequency of the inductive components according to the second and third embodiment. In FIG. 11, a graph 8*a* depicting the ground impedance of the inductive component according to FIG. 8 and a graph 9*a* depicting the inductive impedance of the inductive component according to FIG. 9 is depicted.

It should be noted that by positioning the eyes of the inductor and the ground path, at least some of the inductive effects can be cancelled. Therefore, the ground line or ground path can provide a good ground at the operating frequency of 2 GHz. If the ground line is realized in a low resistivity top metal layer, the residual resistance at the cancellation frequency can be better than that of an inductive component according to FIG. 4.

The planar inductive unit according to the second and third embodiment is adapted to cancel net magnetic fields, to minimize the net inductance of the ground return path and to provide a beneficial inductive coupling for multiple units ins parallel.

Figure 12:
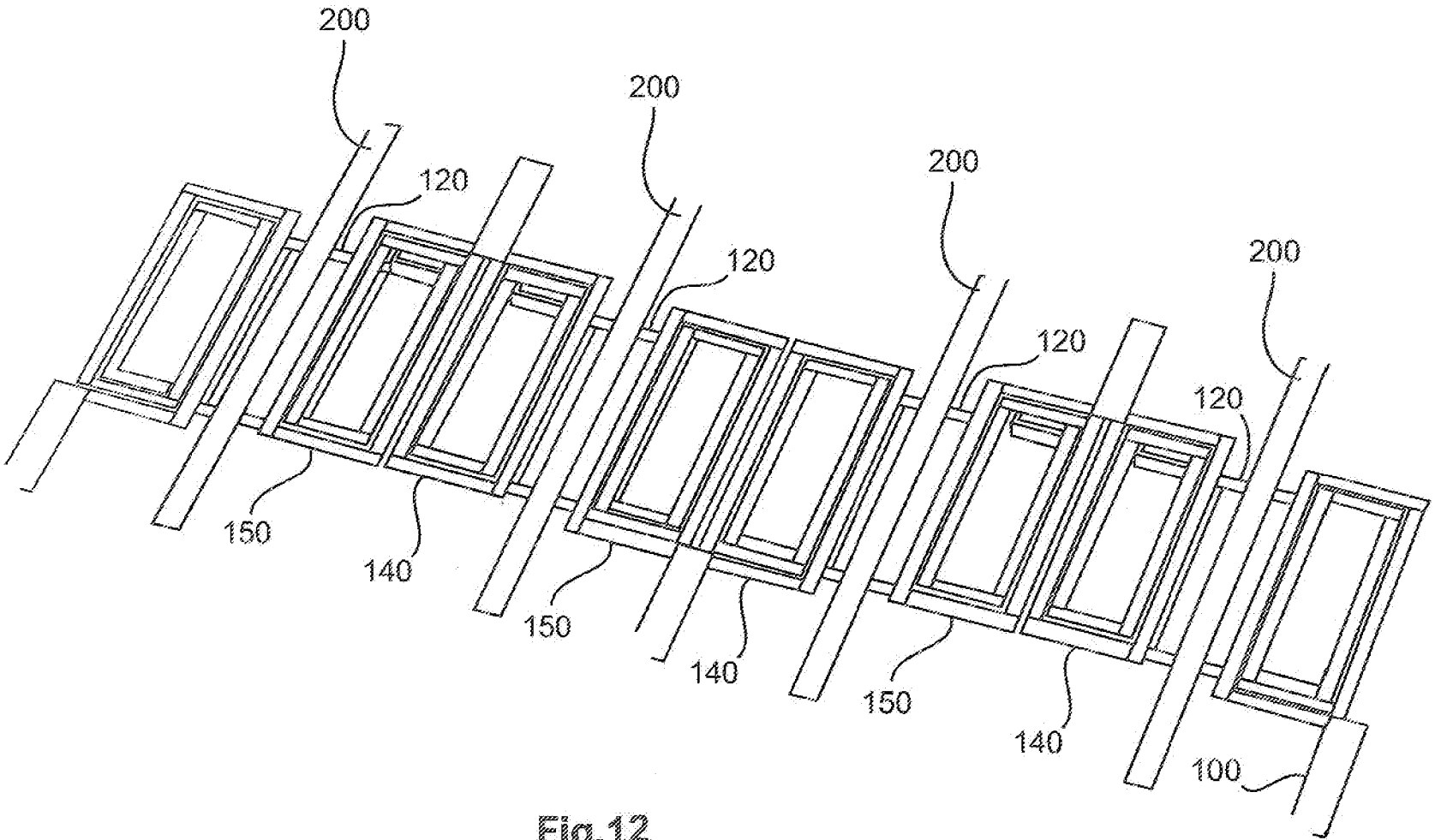
FIG. 12 shows a three dimensional representation of parallel symmetric impedance matching inductors according to a fourth embodiment.

FIG. 12 shows a three dimensional representation of parallel symmetric impedance matching inductors according to a fourth embodiment. Here, each symmetric impedance matching inductor is mirrored with respect to its neighbour. Neighbouring eyes of the inductors are placed at minimum space. The spacing between two eyes of the device can be optimised for minimal net ground inductance or for achieving a more compact layout with some degree of negative ground inductance. The impedance inductors according to the fourth embodiment substantially correspond to the inductive units according to the third embodiment.

Due to the close proximity of mirrored neighbours, the impedance of each unit can be improved from 4.3 nH to 5 nH. Furthermore, Msg is reduced and also allows a reduction of Lg which can be performed by doubling the ground path width. Such a doubling of the ground path width is advantageous with respect to the residual ground resistance per unit at the cancellation frequency which can may involve a factor of 2.

With the planar inductive units according to the above embodiments it is possible to design the inductor such that its terminals can extend to any direction, i.e. the terminals of the inductor can be implemented as depicted in the FIG. 4, 8 or 9, i.e. straight. Alternatively or additionally, the terminals may extend sideways e.g. with a certain angle, such as 90°, 270° and 120°. It should be noted that the above also applies for the ground path. Also combinations of terminals and groundpaths having a variety of angles are envisaged.

The planar inductive unit according to the above embodiments can be used in any electronic device or semiconductor device which requires an inductive component. By means of the invention the size of the inductor can be reduced by 50% while still improving the performance at its operating frequency.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. In the device claim enumerating several means, several of these means can be embodied by one and the same item of hardware. The mere fact that certain measures are recited in mutually different dependent claims does not indicate that a combination of these measures cannot be used to advantage.

Furthermore, any reference signs in the claims shall not be constrained as limiting the scope of the claims.

The invention claimed is:

1. Planar inductive unit having at least one operating frequency, comprising:

at least one inductor winding having a first width and a center and being arranged in a first plane, and at least one ground path having a first section extending in the first plane and at least a second section with a second width extending in at least a second plane.

2. Planar inductive unit according to claim 1, wherein the second width of the second section of the ground path and/or an offset of the second section of the ground path from the center of the at least one inductor winding is selected such that the mutual inductance of the at least one winding and the ground path equals a negative inductance of the ground path at the at least one operating frequency.

3. Planar inductive unit according to claim 1, wherein the at least one inductor winding is arranged in a first metal layer in the first plane and the second section of the ground path is arranged in a second metal layer in the second plane.

4. Planar inductive unit according to claim 1, further comprising:

a ground shield unit being arranged in a third plane for shielding the at least one winding from a substrate.

5. Planar inductive unit having at least one operating frequency, comprising:

at least one figure eight shaped inductor having at least one first eye and at least one second eye being arranged in a first plane and having at least one first width, at least one ground path having a second width and extending in the first plane, wherein the ground path is arranged between the first and second eye of the at least one inductor.

6. Planar inductive unit according to claim 5, wherein said inductor comprises at least one underpass for coupling the first and second eye, wherein the underpass is arranged in a second plane.

7. Planar inductive unit according to claim 5, wherein a distance between the first and second eye and the ground path is selected such that the mutual inductance of the first and second eye and the ground path equals a negative inductance of the ground path at the at least one operating frequency.

8. Electronic device comprising at least one planar inductive unit according to claim 1.

9. Planar inductive unit of claim 7, wherein the ground path is arranged between the first and second eye in the first plane.

10. Planar inductive unit of claim 9, further comprising:

a ground shield located between the first plane and a silicon substrate layer extending in a plane parallel to the first plane; and an electrically conductive via connecting the ground shield and the ground path.

11. Planar inductive unit of claim 5, wherein each of the first and second eye include a plurality of inductor turns, and all inductor turns of each of the first and second eyes are located in the first plane.

12. Planar inductive unit according to claim 1, wherein the at least one inductor winding includes a plurality of inductor turns, and all inductor turns of the at least one inductor winding are located in the first plane.

13. An apparatus, comprising:

a first inductor coil having a first plurality of inductor turns, each of the first plurality of inductor turns located in a first plane and having a first width;

a second inductor coil having a second plurality of inductor turns, each of the second plurality of inductor turns located in the first plane and having the first width, the first and second inductor coils being connected in series;

a ground path conductor having a second width and arranged between the first and second inductor coils in the first plane;

a ground shield located between the first plane and a silicon substrate layer extending in a plane parallel to the first plane;

an electrically conductive via connecting the ground shield and the ground path conductor; and wherein the first and second inductor coils and the ground path conductor are separated by distances at which a mutual inductance of the first and second inductor coils and the ground path conductor equals a negative inductance of the ground path conductor at the at least one operating frequency.

* * * * *